US005808420A

United States Patent [19]

Rilly et al.

[11] Patent Number: 5,808,420

[45] Date of Patent: Sep. 15, 1998

[54] ALTERNATING CURRENT GENERATOR FOR CONTROLLING A PLASMA DISPLAY SCREEN

[75] Inventors: Gerard Rilly, Unterkirnach; Gerard Morizot, Villingen-Schwenningen, both of Germany

[73] Assignee: Deutsche Thomson Brandt GmbH, Villingen-Schwenningen, Germany

[21] Appl. No.: 553,265

[22] PCT Filed: Jun. 24, 1994

[86] PCT No.: PCT/EP94/02057

§ 371 Date: Mar. 11, 1996

§ 102(e) Date: Mar. 11, 1996

[87] PCT Pub. No.: WO95/01627

PCT Pub. Date: Jan. 12, 1995

[30] Foreign Application Priority Data

Jul. 2, 1993 [DE] Germany ..... 43 21 945.4

[51] Int. Cl.[6] ..... H05B 37/02

[52] U.S. Cl. ..... 315/169.4; 315/209 R

[58] Field of Search ..... 315/169.3, 169.4, 315/209 R

[56] References Cited

U.S. PATENT DOCUMENTS 4,070,663 1/1978 Kanatani et al. ..... 340/324
4,958,105 9/1990 Young et al. ..... 315/169.3

FOREIGN PATENT DOCUMENTS 0377955 7/1990 European Pat. Off. .
0420518 4/1991 European Pat. Off. .

OTHER PUBLICATIONS

1987 SID International Symposium—Digest of Technical Papers, vol. 18, 12 May 1987, L.F. Weber etal "Energy Recovery Sustain Circuit for the AC Plasma Display", pp. 92–95.

1976 SID International Symposium—Digest of Technical Papers, 4 May 1976, C. Suzuki etal "Character Display using Thin–Film EL Panel with Inherent Memory", pp. 50–51.

*Primary Examiner*—Robert Pascal
*Assistant Examiner*—Michael Shingleton
*Attorney, Agent, or Firm*—Joseph S. Tripoli; Frederick A. Wein

[57] ABSTRACT

In a plasma display screen them is a circuit which alternately applies a positive and negative voltage to the general capacitance of the screen or panel for a reset process. In the current path there is an inductance to ensure the recovery of the energy to the total capacity. The aim is to improve the drive and the erase process of a pixel in such a circuit The capacity (Cp) is cyclically connected via a third switch (T3) to such a third operating voltage that the voltage (UCp) at the capacitance (Cp) has a period of zero voltage between those of positive and negative voltage. Especially for a control circuit for a plasma display screen for a television receiver.

4 Claims, 6 Drawing Sheets

ALTERNATING CURRENT GENERATOR FOR CONTROLLING A PLASMA DISPLAY SCREEN

The invention is based on a generator for controlling a plasma display screen. Such a generator is disclosed in Document 92 SID DIGEST 1987, pages 92 to 95.

In the case of such a plasma display screen, every pixels represents a capacitance. An alternating voltage which periodically charges and discharges the total capacitance of the screen is required for the basic polarization of the line addressing and, initially, this means a considerable energy loss. In order to reduce the energy loss, it is known for an inductance to be connected in the charging path of the capacitance, which inductance acts in the sense of so-called energy recovery. The energy resulting from the voltage on the capacitance is in this case periodically displaced into energy in the form of current in the coil. In this way, up to 90% energy recovery can be achieved. The voltage across the capacitance reverses its polarity as a result of the resonant discharge. This means that the voltage difference across the capacitance is twice the applied operating voltage. This known circuit is also called a Weber-Wood circuit.

SUMMARY OF THE INVENTION

The invention is based on the object of modifying the described circuit such that the triggering process to excite the individual pixels to illuminate is improved.

The known generator for line control operates with two voltage values for the voltage on the total capacitance. In the case of the circuit according to the invention, a further period at a third voltage value, for example zero, is deliberately inserted between the periods at the two different voltage values for triggering and turning off, in order to delete or to neutralize the information of the respective pixel in the plasma. A transition in the form of a sinusoidal half-cycle in this case always takes place between each two different, successive voltage values. The period at the third voltage value considerably improves the deletion or so-called reset of the pixel. The two positive and negative voltage values of different magnitude allow the excitation of the pixel to be optimized. In this case, the lines and the columns can be addressed with relatively low voltages which are precisely matched, independently of one another, to the control range of the plasma. The additional addressing circuits can then receive optimum voltage values.

The total capacitance is preferably connected cyclically to earth via a third switch, such that the voltage across the capacitance has a period of the voltage zero value between periods at a positive and a negative voltage. The connection of the capacitance is preferably connected to an operating voltage via the inductance and the second switch, and to earth via the third switch. The second operating voltage is in this case preferably equal to half the first operating voltage.

An extended solution having four transitions for both polarities comprises that connection of the capacitance which is connected to the first end of the inductance being connected to earth via two parallel switches having opposite forward directions, to a positive operating voltage via a first switch and to a second operating voltage of equal magnitude via a second switch, and the second end of the inductance being connected to half the first operating voltage via two parallel switches having opposite forward directions, and to half the second operating voltage via two further switches having opposite forward directions. The switch paths having different forward directions are in this case preferably each formed by connecting a switch and a diode in series.

BRIEF DESCRIPTION OF THE DRAWINGS

The invention is explained in the following text, using a plurality of exemplary embodiments and referring to the drawing, in which.

DETAILED DESCRIPTION OF THE PREFERRED EMBODIMENT(S)

Figure 1:
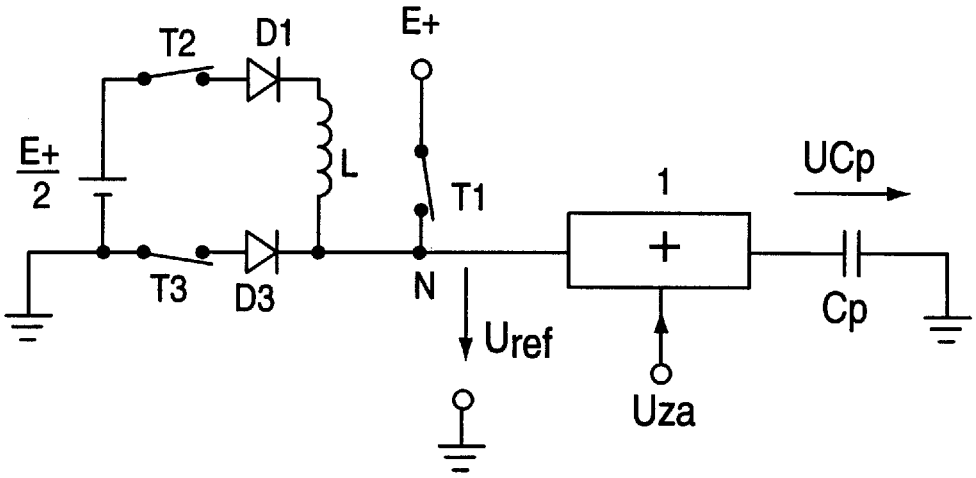
FIG. 1 shows a simple block diagram of the circuit according to the invention for one polarity of the voltage across the capacitance.

In FIG. 1, Cp means the total plasma capacitance or panel capacitance of a plasma screen. Only the circuit elements for changing the charge of Cp between 0 and a positive voltage are shown, and not the other circuit elements for correspondingly changing the charge between zero and the negative voltage. An additional voltage Uza is added between the point N and the non-earthed connection of the capacitance Cp, via the stage 1, which additional voltage Uza is used for addressing an entire line and at the same time selects a specific line. For the addressing process, an increased voltage is in each case applied to a line and, in addition, a voltage for the column addressing, which can be thought of as being on the opposite side of Cp. This line addressing and column addressing results in one pixel being addressed in each case. The point N is connected to the positive operating voltage E+ via the first switch T1, to earth via the series circuit formed by the switch T3 and the diode D3, and to the voltage source having the value E+/2 via the coil L which is used for energy recovery, the diode D1 and the switch T2. L is the inductance which is used for energy recovery and in which the energy stored in Cp in the form of voltage UCp is recovered in the form of a current.

Figure 2:
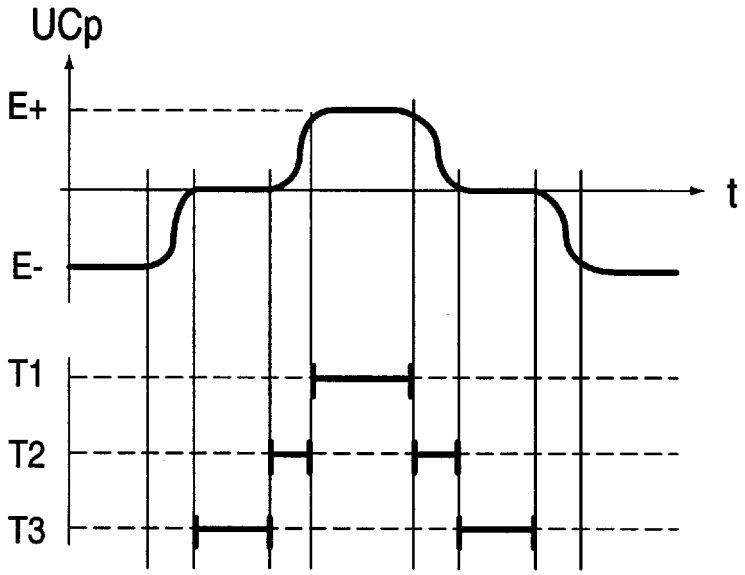
FIG. 2 shows curves to explain the function of the circuit according to FIG. 1.

FIG. 2 shows the behaviour with respect to time of the voltage UCp across the capacitance Cp for one period. In this case, the solid lines at T1, T2, T3 indicate the periods during which the switches are switched on. It can be seen that the switch T2 is in each case switched on during the transitions, that is to say when the charge on Cp is changing between 0 and E+. In comparison with T2, T1 and T3 result in the connection a being connected to the voltage E+ for longer, during the triggering phase and to earth during the period at the voltage value of zero. For simplicity, FIG. 1 is illustrated for only one polarity, that is to say only the connection to E+ and earth. It can be seen that the voltage UCp across the capacitance Cp assumes three different voltage values, in this example E−, 0 and E+, during one period. A transition in the form of a sinusoidal half-wave or 180° of a sinusoidal oscillation, between the voltage values 0 and E+ takes place in each case during the phase in which T2 is switched on, because T2 is connected to the voltage source E+/2. Thus, the process of changing the charge between 0 and E+ is, so to say, a rotation about the mean voltage E+/2. The additional means for the transition from E− to 0 and from 0 to E− are not illustrated in FIG. 1. These are the additional switch paths T6, D6 and T6−, D6−, respectively, in FIG. 3. This control using three different voltage values and a resonant oscillation in each case between two different successive voltage values considerably improves the drive to the capacitance Cp, to be precise, in particular, the excitation of the respective pixel to illuminate by means of one of the voltage values, preferably the illustrated voltage value E+.

Figure 3:
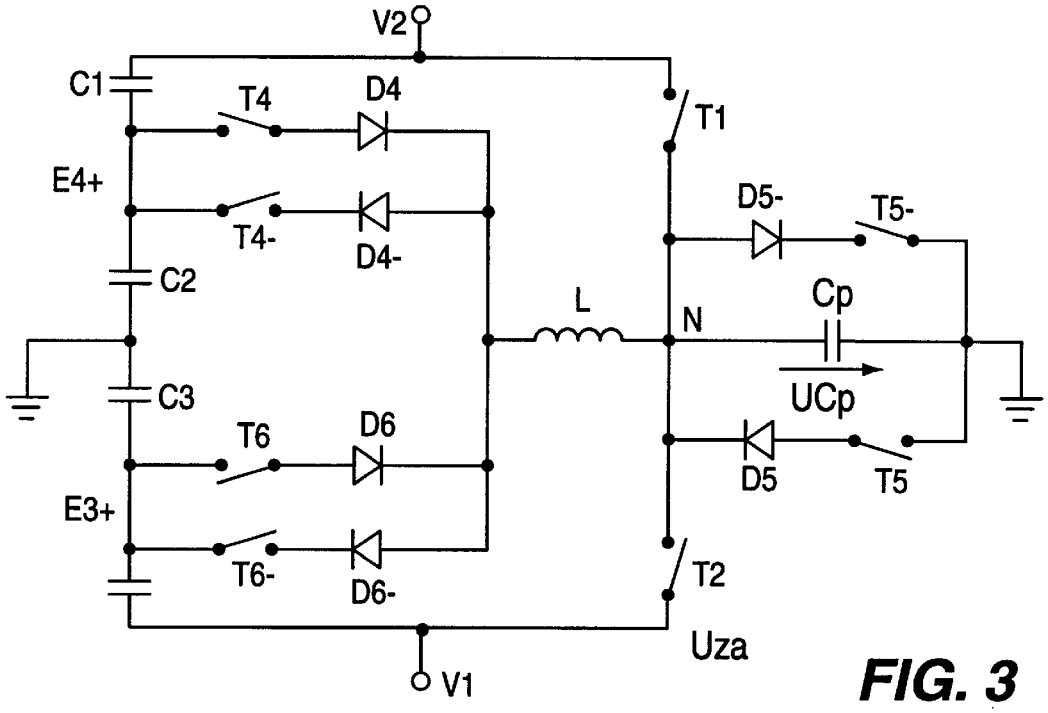
FIG. 3 shows an extended circuit for both polarities and four transitions.
Figure 4:
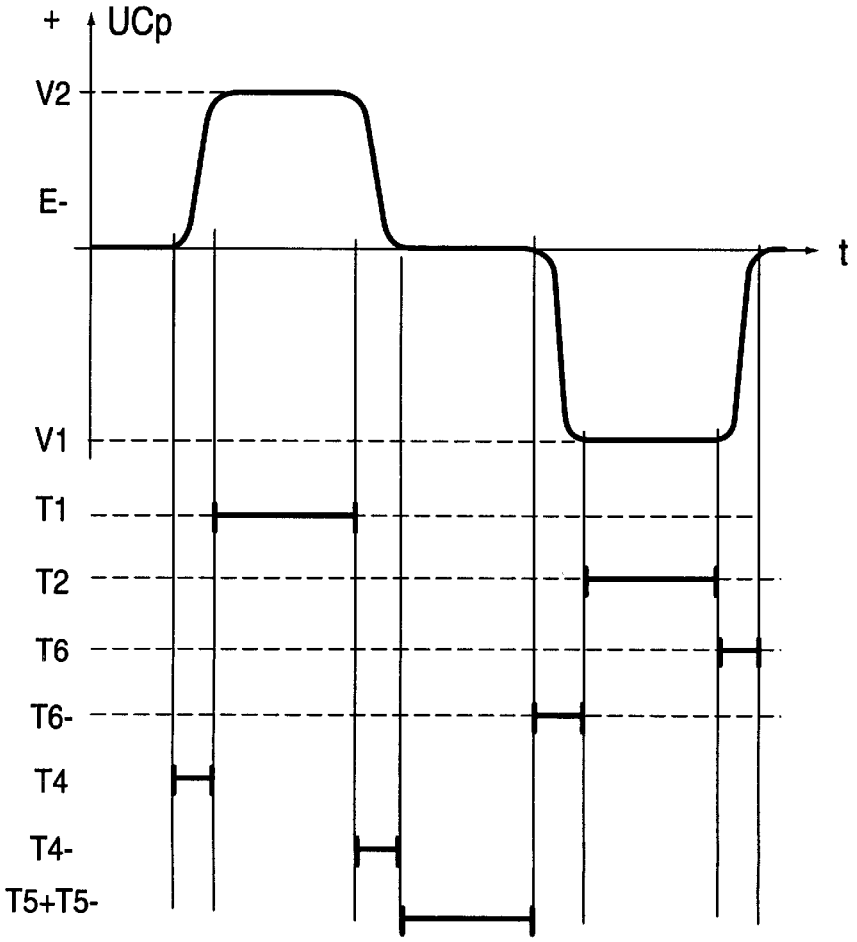
FIG. 4 shows curves to explain the method of operation of the circuit according to FIG. 3.

FIG. 3 shows the extension of the circuit according to FIG. 2 for both polarities, and three voltage values according to FIG. 2. Thus, for the illustrated voltages E3 and E4: E3=−V1/2, E4=+V2/2. The circuit according to FIG. 3 operates essentially on the same principle as the circuit according to FIG. 1, the concordance being as follows, in order to assist understanding:

| FIG. 4 | | FIG. 1 | |
|---|---|---|---|
| T4−, | D4− | T2, | D1 |
| T4, | D4 | T2, | D1 |
| T6, | D6 | T2, | D1 |
| T6−, | D6− | T2, | D1 |
| T5−, | D5− | T3, | D3 |
| T5, | D5 | T3, | D3 |
| T1 | | T1 | |
| T2 | | | |

Cp is once again the total capacitance. The actual energy flow takes place via T1, T2. The frequency at which the changing charge takes place is approximately 30 to 100 kHz.

The solid lines in FIG. 4 once again show which of the switches T1–T6 in FIG. 3 are switched on in the individual time elements in one period. It can be seen that the switch paths T4/D4, T4−/D4−, T6/D6 and T6−/D6− are all switched on during the change in the charge of Cp, that is to say the transitions of UCp. In their phase when they are switched on, T1, T2 once again result in the connection a of the capacitance Cp to V2 and V1 being longer than the transition, while the switch paths T5/D5 and T5−/D5− result in the connection a being connected to earth in between, in terms of time, in order to form the described time intervals at the voltage value zero. It can be seen that the voltage values V2 and V1 are of different magnitude, for matching to the plasma screen, for example V2=120 volts and V1=−150 volts.

Figure 5:
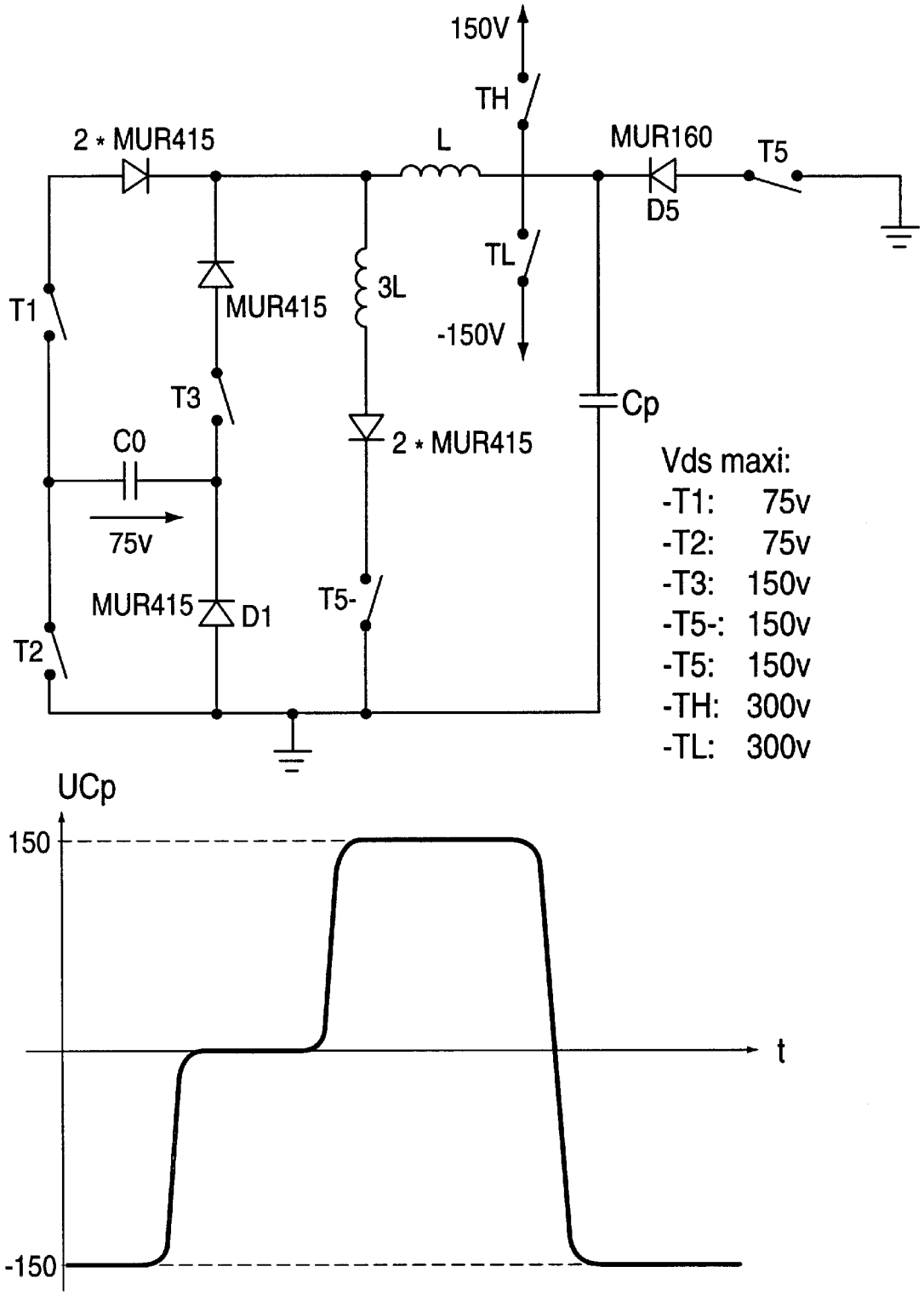
FIG. 5 shows a variant of the circuit according to the invention.

FIG. 5 shows an alternative solution to FIG. 3. The current for the triggering phase, that is to say the excitation to illuminate, flows essentially via the transistors TH and TL which are illustrated as switches. Splitting between a number of current paths also makes sense in the case of a particularly large plasma screen, because of the relatively high currents required. The change in the charge Cp takes place on the basis of the design of the switches T1, T2; T3, T1. The mean voltage of Cp is zero only when the voltages V2 and V1 are balanced, that is to say are of equal magnitude.

Figure 6:
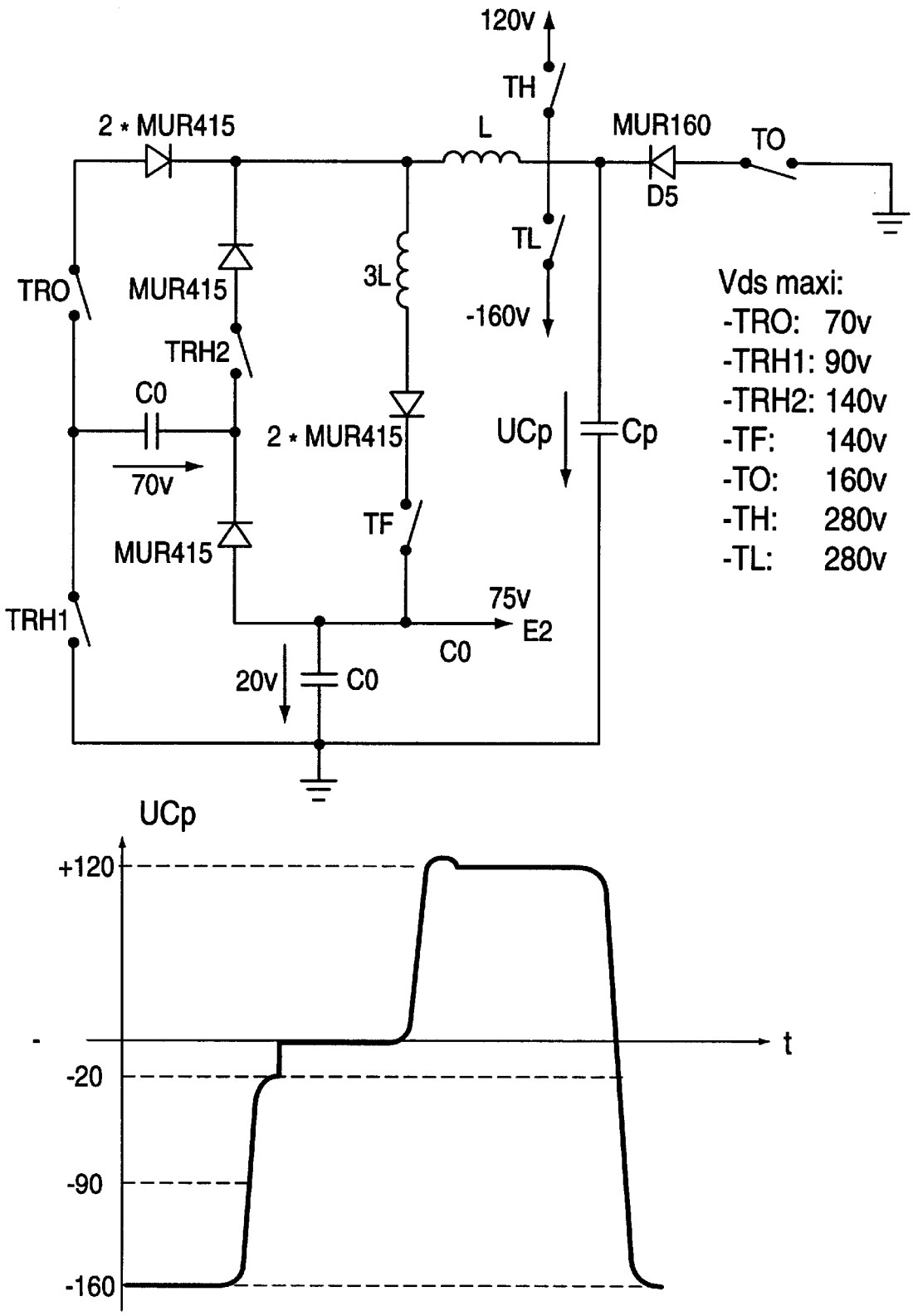
FIG. 6 shows a further variant of the circuit.

FIG. 6 shows a further alternative solution with the capability to unbalance the extreme voltages, in that an auxiliary source E2 is introduced which is equal to half the amplitude difference of UCp across Cp.

Figure 7:
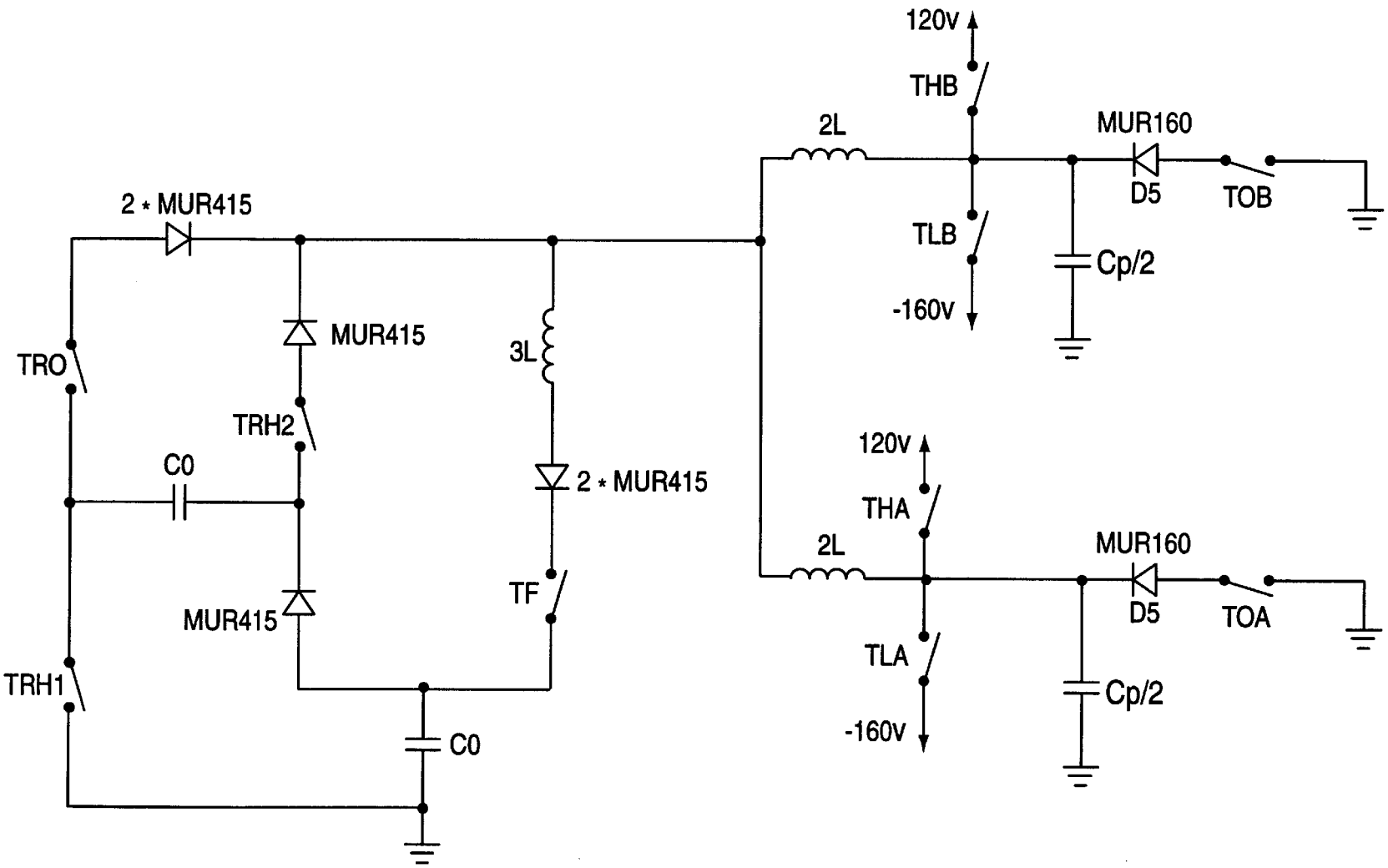
FIG. 7 shows a circuit variant for a screen having particularly large dimensions.
Figure 8:
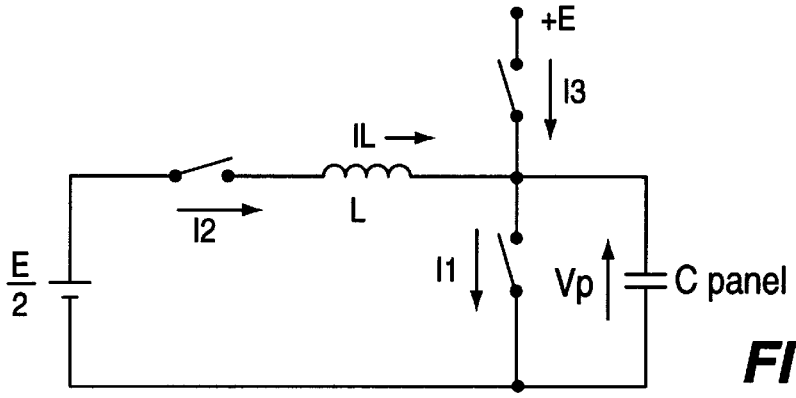
FIGS. 8–12 represent various aspects of the invention.

FIG. 7 shows a variant for a plasma screen having large dimensions. The majority of the energy which is transmitted via the switches TH and TL for the screen is split into two parts, to each of which a corresponding maintenance circuit THB-TLB is assigned. This circuit shows the possibility of using a common resonant circuit.

The compensation for the losses during the resonance is described in the following text, with reference to the FIGS. 8–12.

Figure 9:
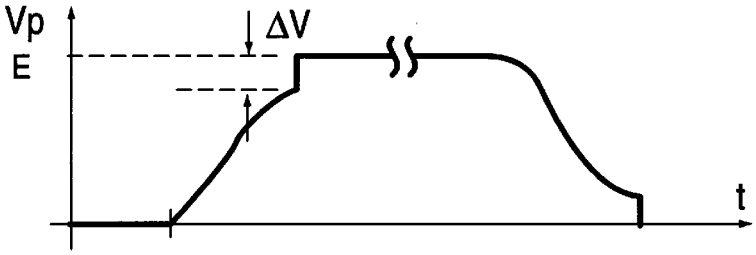
Figure 10:
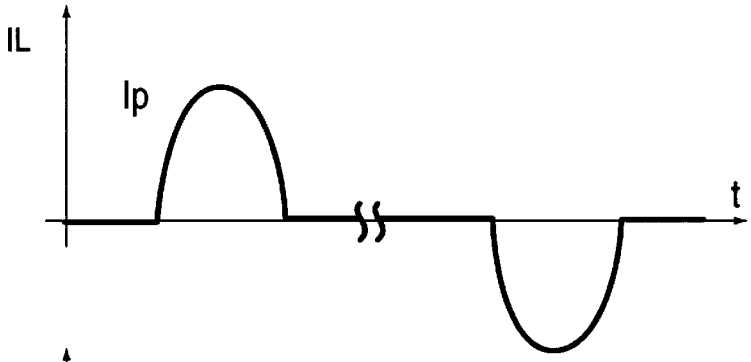
Figure 11:
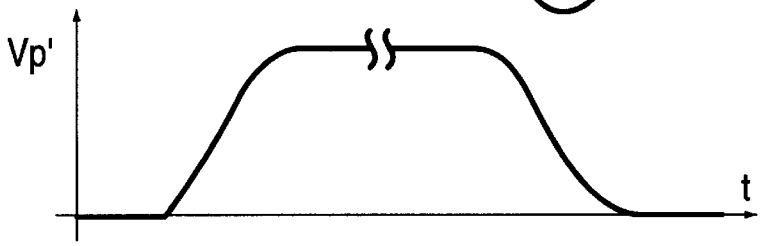
Figure 12:
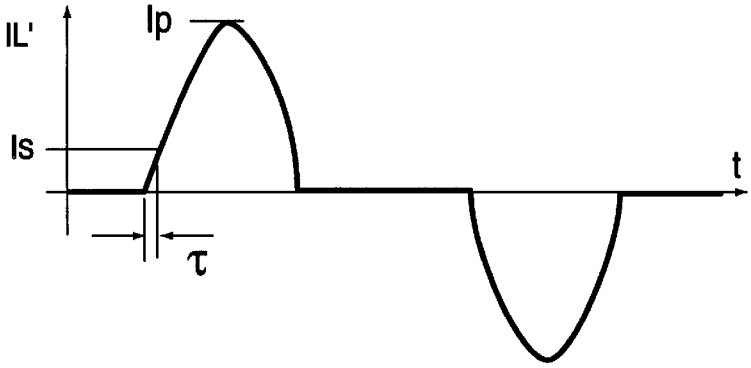

If, according to FIGS. 9 and 10, the current I1 is switched off at the point in time at which the current I2 is switched on, no energy is transmitted into the inductance L before the resonant behaviour between L and Cpanel.

The energy which exists at the point in time when resonance starts is:

$$\frac{1}{2}\,C\,\frac{E^2}{2-}$$

Because of losses during the resonant behaviour, the voltage Vp does not reach the voltage E at the end of resonance, as a result of which a current pulse I3 is produced when this switches on.

If, in contrast to this, the current I2 is switched on before the current I1 is switched off, a current flows through the inductance L, and the current I1 stores energy in the inductance. When I1 is switched off, the energy which exists in the resonance behaviour is $$\frac{1}{2}\,LIs^2+\frac{1}{2}\,C\,\frac{E^2}{2}\ :$$

The addition of $$\frac{1}{2}\,LIs^2$$

making it possible to compensate for the losses during the resonant process (losses in L, I2 and Cp), as a consequence of which I'p>Ip.

The delay $\tau$ is set to provide suitable compensation for the losses, so that Vp precisely reaches the voltage E at the end of the quarter period.

With reference to FIG. 3 of the application, it can be seen that such a delay in the switches T5− and T5+ should be applied appropriately to the transition.

We claim:

1. Alternating current generator for controlling the line addressing of a plasma display screen, comprising:

a generator connection of a screen capacitance is cyclically and successively connected via switches to different operating voltages, an inductance for energy recovery is located in the path of a charge-changing current for the capacitance.

the capacitance is successively connected via switches to different operating voltages so that voltage across the capacitance cyclically and successively assumes three voltage values of different magnitude with transitions in between them, the connection of the capacitance connected to a first end of the inductance is connected to earth via two parallel switches having opposite forward directions, to a positive operating voltage via a switch and to a second operating voltage via a second switch, a second end of the inductance is connected to a first operating voltage via two parallel switches having opposite forward directions, and to a second operating voltage via two further switches having opposite forward directions.

2. Generator according to claim 1 wherein the voltage across the capacitance has an interval at a voltage zero value between an interval at the positive voltage and an interval at a negative voltage.

3. Generator according to claim 2, wherein the positive voltage and a negative voltage are of different magnitude.

4. Alternating current generator for controlling the line addressing of a plasma display screen, comprising:

a generator connection of a screen capacitance is cyclically and successively connected via switches to different operating voltages, an inductance for energy recovery is located in the path of a charge-changing current for the capacitance.

the capacitance is successively connected via switches to different operating voltages so that voltage across the capacitance cyclically and successively assumes three voltage values of different magnitude with transitions in between them, the connection of the capacitance connected to a first end of the inductance is connected to earth via two parallel switches having opposite forward directions, to a positive operating voltage via a switch and to a second operating voltage via a second switch, a second end of the inductance is connected to a first operating voltage via two parallel switches having opposite forward directions, and to a second operating voltage via two further switches having opposite forward directions.

at least one switch, which is connected in parallel with the screen capacitance cannot be switched off until after a current for charging the inductance is connected by switches to a second end of said inductance, so that losses during resonance are compensated for.

* * * * *